United States Patent [19]

Fletcher

[11] Patent Number: 4,666,047

[45] Date of Patent: May 19, 1987

[54] HANGER SUPPORT FOR FILING CABINETS

[75] Inventor: William C. Fletcher, Islington, Canada

[73] Assignee: Plan Hold Canada Inc., Islington, Canada

[21] Appl. No.: 809,322

[22] Filed: Dec. 16, 1985

[51] Int. Cl.[4] ..... A47F 7/16

[52] U.S. Cl. ..... 211/46; 211/162; 312/184

[58] Field of Search ..... 211/46, 45, 47, 162; 312/184, 185, 187

[56] References Cited

U.S. PATENT DOCUMENTS

| | | | |
|---|---|---|---|
| 1,867,159 | 7/1932 | Kline | 312/184 |
| 2,253,788 | 8/1941 | Kern | 211/45 |
| 2,851,167 | 9/1958 | Rosenberg | 211/46 |
| 2,869,210 | 1/1959 | Schneider | 211/46 X |
| 3,208,457 | 9/1965 | Zippel | 211/46 |
| 3,570,678 | 3/1971 | Lundberg | 211/46 |
| 3,905,480 | 9/1975 | Grinceri | 211/45 |
| 4,579,231 | 4/1986 | Price | 211/162 X |

FOREIGN PATENT DOCUMENTS

| | | | |
|---|---|---|---|
| 1068874 | 6/1954 | France | 312/184 |

*Primary Examiner*—Carl D. Friedman
*Assistant Examiner*—Caroline D. Dennison
*Attorney, Agent, or Firm*—Fetherstonhaugh & Co.

[57] ABSTRACT

A suspension system for use in suspending a plurality of hangers within a storage space of a filing cabinet or the like comprises front and back stationary rails and a plurality of suspension rails. The front and back stationary rails are mounted in a spaced parallel relationship and extend across said storage space. The front and back storage rails each have a lower end at which a suspension flange is formed. The backrail has a plurality of seats formed in its suspension flange at spaced intervals along the length thereof. The suspension rails each have a front end, a back end and an upper and a lower edge extending longitudinally between the front and back ends thereof. Each suspension rail has front and back suspension notches formed in the front and back end of said upper edge to form slipways through which the flanged lower edge of the stationary rails extend. Each slipway has a lug projecting inwardly at its upper edge which overlies the flange of the stationary rail which extends therethrough thereby to suspend the suspension rails from the stationary rails. The lugs of the back suspension notch are releaseably seated in the seats of the back stationary rail so as to releaseably retain the back end of the suspension rails against movement along the back stationary rail while permitting movement of the front end suspension rails along the front stationary rail. The suspension rails are each adapted to support a hanger.

3 Claims, 6 Drawing Figures

FIG. 3
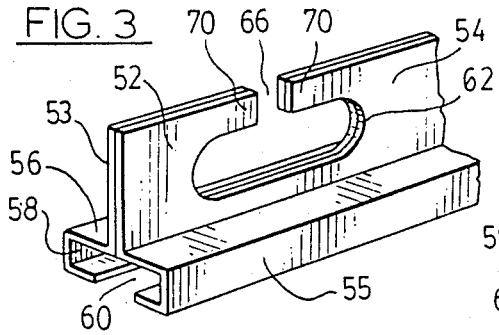
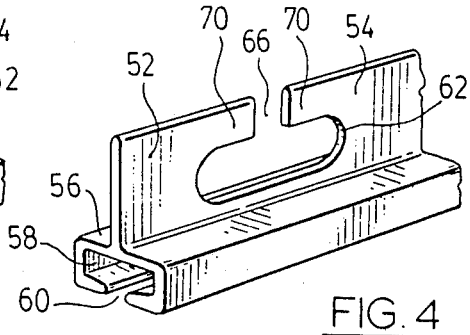
FIG. 4
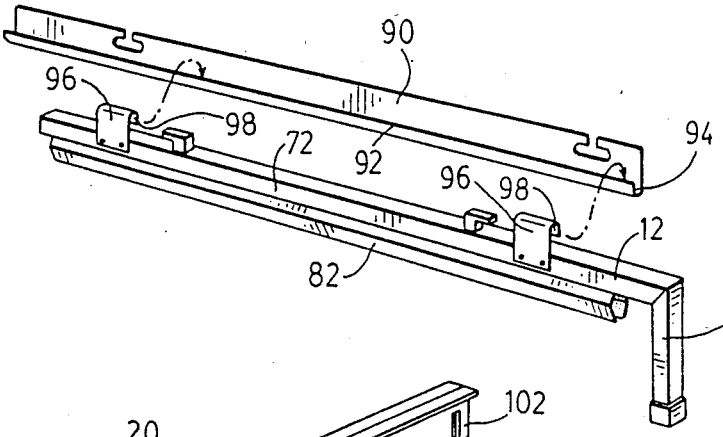
FIG. 5
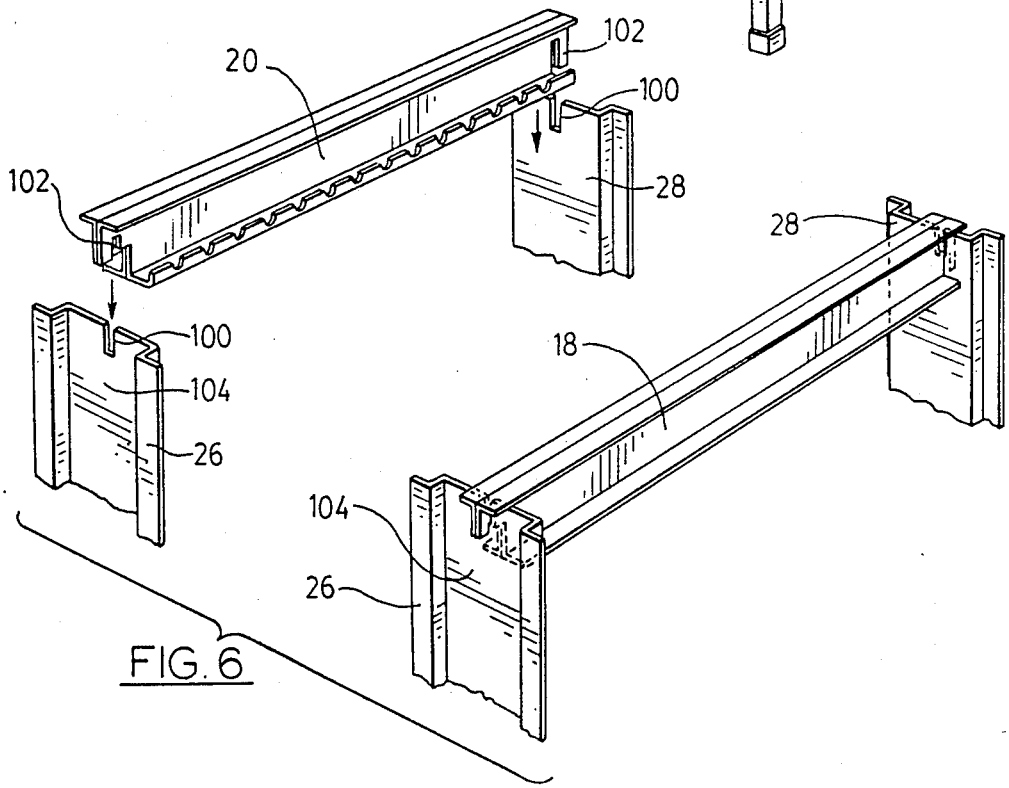
FIG. 6

HANGER SUPPORT FOR FILING CABINETS

FIELD OF INVENTION

This invention relates to a suspension system for use in suspending a plurality of hangers within a storage space of a filing cabinet or the like.

PRIOR ART

Suspension systems for use in suspending plans or drawings are well known, however, they are generally made from a large number of components which must be individually fabricated and which require careful and time consuming assembly.

In one known suspension system, front and back stationary rails are formed with T-shaped channels in the lower edge thereof and the suspension rails each have corresponding T-shaped plastic inserts mounted on the upper edge thereof which are threaded into the T-shaped slots of the stationary rails. In order to space the back end of the suspension rails, the plastic inserts are transversely elongated. These components must be individually manufactured and the assembly of the components and the fitting of these components is difficult and time consuming.

It is an object of the present invention to provide a simple and inexpensive suspension system for use in suspending a plurality of hangers within a storage space of a filing cabinet or the like.

SUMMARY OF INVENTION

I have found that the number of components required in the structure of the suspension assembly can be reduced by forming a mounting flange at the lower edge of the front and back stationary support rails and by forming a complementary mounting slot in the upper edge of the suspension rails such that the suspension rails can be threaded onto the stationary rails. This eliminates the need to provide an additional mounting component and simplifies the mounting the suspension rails on the stationary rails. In addition, I have found that the back ends of the stationary rails can be retained in spaced relationship with respect to one another by providing notches in a lip formed on the back stationary rail which forms seats for receiving the back end of the suspension rail. Again, by constructing the seats at an integral part of the back suspension rail, the need to provide a spacing component has been eliminated.

According to one aspect of the present invention a suspension system for use in suspending a plurality of hangers within a storage space of a filing cabinet or the like comprises front and back stationary rails mounted in a spaced parallel relationship and extending across said storage space, said front and back storage rails each having a lower end and a suspension flange extending longitudinally of and projecting laterally from said lower end, said backrail having a plurality of seats formed in said suspension flange at spaced intervals along the length thereof, a plurality of suspension rails each having a front end, a back end and an upper and a lower edge extending longitudinally between the front and back ends thereof, said suspension rail having front and back suspension notches formed in the front and back end of said upper edge to form slipways through which the flanged lower edge of the stationary rails extend, each slipway having a lug projecting inwardly at said upper edge which overlies the flange of the stationary rail which extends therethrough thereby to suspend the suspension rails from the stationary rails, the lugs of the back suspension notch being adapted to be releaseably seated in the seats of the back stationary rail so as to releaseably retain the back end of the suspension rails against movement along the back stationary rail while permitting movement of the front end suspension rails along the front stationary rail, said suspension rails each being adapted to support a hanger.

BRIEF DESCRIPTION OF DRAWINGS

The invention will be more clearly understood after reference to the following detailed specification read in conjunction with the drawings wherein:

FIG. 3 is a pictorial view of a portion of a rolled sheet metal suspension rail;

FIG. 4 is a pictorial view similar to FIG. 3 showing an extruded suspension rail;

FIG. 5 is a pictorial view illustrating an alternative form of suspension rail and hanger mounting arrangement;

FIG. 6 is a partially exploded pictorial view of an alternative form of mounting for the stationary rails.

With reference to FIG. 1 of the drawings, the reference numeral 10 refers generally to a suspension system for use in suspending a plurality of hangers 12 in the storage space 14 of a filing cabinet 16.

Figures 1, 2:
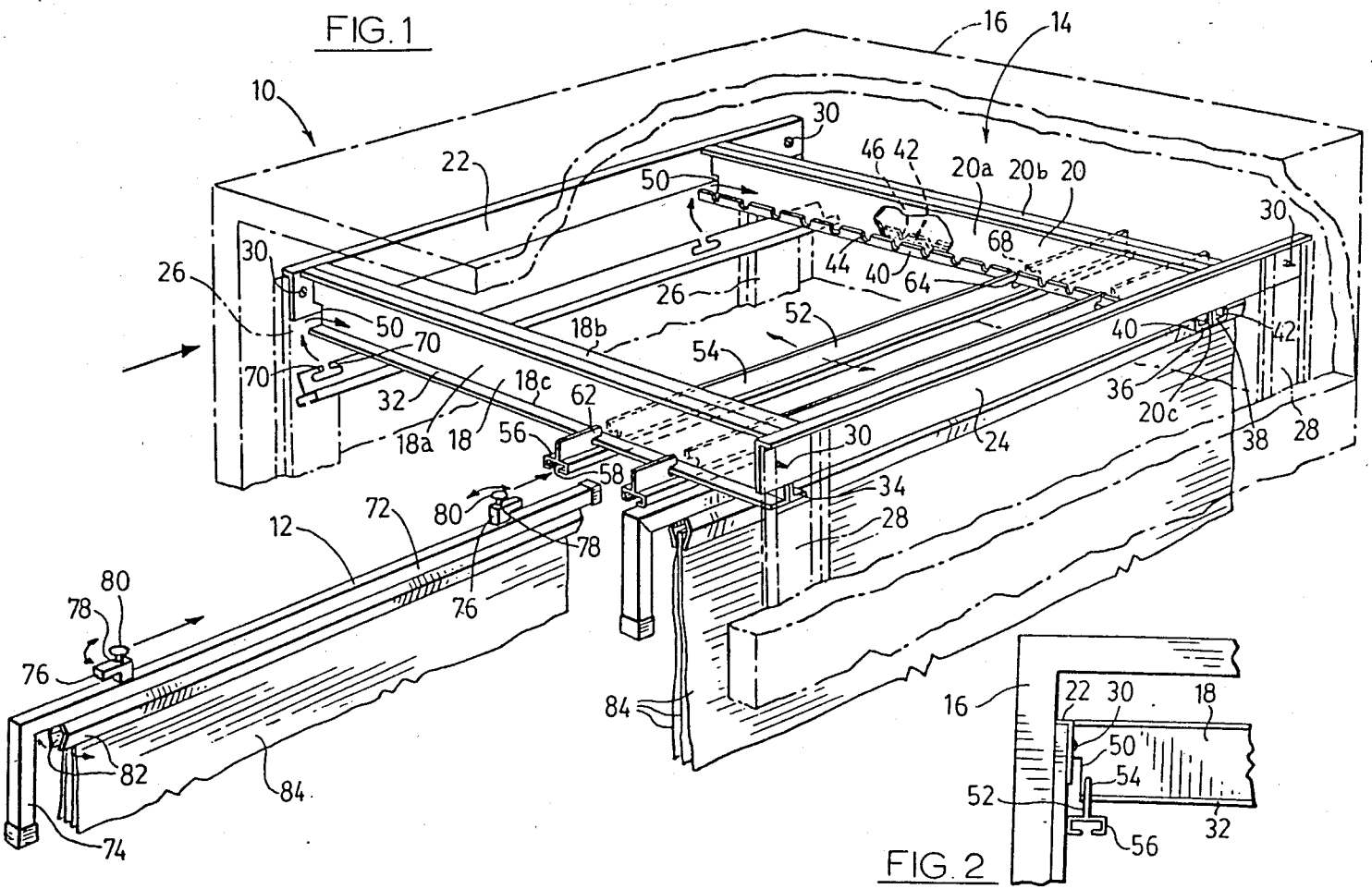
FIG. 1 is a partially exploded pictorial view of a suspension system constructed in accordance with an embodiment of the present invention.
FIG. 2 is a view in the direction of the arrow A of FIG. 1 showing the suspension rail mounted on the stationary rails.

The suspension system 10 comprises front and back stationary rails 18 and 20 which are retained in a spaced parallel relationship by means of longitudinal beams 22 and 24 to which they are welded or otherwise secured. The beams 22 and 24 are secured to frame members 26 and 28 by mounting screws 30. The front stationary rail 18 is formed from a pair of U-shaped channel members **18*a* and 18*b* which are secured as by spot welding in a face to face relationship. Similarly, the back stationary rail 20 is formed from U-shaped channel members 20*a* and 20*b*. Suspension flanges 32 and 34 project laterally from the lower edge 18*c* of the front stationary rail 18. Suspension flanges 36 and 38 project laterally from the lower edge 20*c* of the back stationary rail 20**.

A lip 40 may be provided on and project upwardly from the flange 36 or a lip 42, which is shown in broken lines in FIG. 1, may be provided on and project upwardly from the flange 38. One or other of the lips 40 or 42 is required but not both. When the lip 40 is provided notches 44 are formed along its upper edge and when the lip 42 is provided notches 46 are formed along its upper edge. Recesses 50 and 52 are formed at one end of the stationary rails 18 and 20 and extend upwardly from the lower edges **18*c* and 20*c***.

A plurality of suspension rails 52 are provided, usually one for each seat formed in the back stationary rail 20. The suspension rails 52 each comprise a vertical leg 54 which extends upwardly from a base 56 within which a T-shaped channel 58 is formed (FIG. 4). The channel 58 has an opening 60 which extends longitudinally of the suspension rail. T-shaped notches 62 and 64 are formed adjacent the front and back ends respectively of the suspension rail 52. The notches 62 and 64 have passages 66 and 68 opening upwardly therefrom. The T-shaped slots 62 and 64 are proportioned to receive the suspension flanges 32, 34 and 36, 38 respectively in a free fitting relationship. The passages 66 and 68 are narrower than the flanges so that the lugs 70 which are formed on opposite sides of the passages 66, 68 will overlie and bear against the flanges 32, 34 and 36, 38 to permit the suspension rails 52 to be suspended from the front and back stationary rails 18 and 20.

The vertical leg 54, base 56 and the T-shaped notches 62, 64 are proportioned to permit the suspension rail to be mounted on the stationary rails by tilting the suspension rail as shown in FIG. 1 to permit the vertical rail to pass upwardly into the recess 50 to permit the lugs 70 to pass over the suspension flanges 32, 34 and 36, 38. Thereafter, the suspension rail 52 assumes the position shown in FIG. 2 wherein the base 56 is sufficiently wide to prevent the removal of the vertical lug 54 without tilting.

In the embodiments illustrated in FIG. 3 of the drawings, the suspension rail 52 is formed from two sheet metal components 53 and 55 which are rolled to the required configuration and are secured to one another by spot welding or the like.

In the embodiments illustrated in FIG. 4 of the drawings, the suspension rail 52 is a unitary extruded body which may be made from an extruded aluminum alloy or the like.

The hanger 12 (FIG. 1) may be of a conventional construction comprising a horizontal beam 72 which has a vertical handle 74 at one end thereof. A pair of L-shaped plastic brackets 76 are mounted on the horizontal beam 72 and project upwardly therefrom. Pins 78 which have enlarged head portions 80 project upwardly from the brackets 76 and are proportioned to fit in a close fitting sliding relationship within the T-shaped channels 58. A pair of clamping jaws 82 are disposed opposite one another and extend downwardly from the horizontal beam 72. The jaws 82 may be opened to receive and closed to clamp a plurality of sheets 84 of drawings or the like therebetween.

A modified suspension rail 90 is illustrated in FIG. 5 of the drawings. In this embodiment, the lower edge 92 is hook-shaped to provide an upwardly opening channel 94 which is functionally the equivalent of the T-shaped channel 58 of the suspension rail 52. Hanger brackets 96 are mounted on the horizontal beam 72 to replace the pins 78. The hanger brackets 96 have a hook-shaped upper end which forms a downwardly opening channel 98.

The hangers 12 can be suspended from the suspension rails 90 by locating the hook-shaped ends of the brackets 96 within the channel 94.

A further modification is illustrated in FIG. 6 of the drawings wherein the frame members 26 and 28 are each formed with notches 100 and the front and back stationary rails are formed with notches 102. The stationary rails 18 and 20 can be releaseably mounted on the frame members 26 by sliding the rails downwardly over the frame members so that the portions of the front and back stationary rails 18 and 20 which extends above the notch 102 is seated in the notch 100 of the frame members 104 as shown by the position of the front stationary rail 18 illustrated in FIG. 6. This structure has the advantage of permitting an existing cabinet to be modified by mounting the frame members 104 adjacent opposite walls and thereafter mounting the front and back stationary rails without requiring welding of the stationary rails.

From the foregoing, it will be apparent that the present invention provides a simple and inexpensive form of suspension system.

In use, the suspension rails 52 are mounted on the front and back stationary rails as previously described and located so that the back end of each suspension rail is seated in a seat 44 so as to be retained in a spaced relationship. The various hangers are then mounted on the suspension rails as previously described. To facilitate examination of the sheets or drawings 84 which are suspended from the hangers 12, it is possible to move the front ends of the hangers 12 laterally away from one another because no spacers are provided therebetween. Having located a particular hanger, the hanger may be removed simply by pulling on the handle 74.

By utilizing T-shaped notches in the suspension rails, I have reduced a number of components necessary to form the suspension rails. In addition, by forming seats on the back stationary rail which receive the lugs which are provided when the T-shaped notches are formed in the suspension rails, I have been able to provide the required spacing without the need to provide a spacing component.

Various modifications of the present invention will be apparent to those skilled in the art without departing from the scope of the invention. It will be apparent that while I have shown the suspension rails having T-shaped slots 62, these may be replaced by L-shaped slots in which case only one suspension flange is required at the lower end of the front and back stationary rails.

The embodiments of the invention in which an exclusive property or privilege is claimed are defined as follows:

1. A suspension system for use in suspending a plurality of hangers within a storage space of a filing cabinet or the like comprising:

(a) front and back stationary rails mounted in a spaced parallel relationship and extending across said storage space, said front and back storage rails each having a lower end and a suspension flange extending longitudinally of and projecting laterally from said lower end, said backrail having a plurality of seats formed in said suspension flange at spaced intervals along the length thereof, (b) a plurality of suspension rails each having a front end, a back end and an upper and a lower edge extending longitudinally between the front and back ends thereof, each suspension rail having front and back suspension notches formed in the front and back end of said upper edge to form slipways through which the flanged lower edge of the stationary rails extend, each slipway having a lug projecting inwardly at said upper edge which overlies the flange of the stationary rail which extends therethrough thereby to suspend the suspension rails from the stationary rails, the lugs of the back suspension notch being adapted to be releasably seated in the seats of the back stationary rail so as to releasably retain the back end of the suspension rails against movement along the back stationary rail while permitting movement of the front end suspension rails along the front stationary rail, said suspension rails each being adapted to support a hanger, (c) each of said stationary rails having a recess extending upwardly from the lower edqe at one end thereof, which permits the upper edge of the suspension rail to project above the suspension flange of the stationary rails to permit the suspension flanges of the stationary rail to be threaded into the slipways of the suspension rails.

2. A suspension system for use in suspending a plurality of hangers within a storage space of a filing cabinet or the like comprising:

(a) front and back stationary rails mounted in a spaced parallel relationship and extending across said storage space, said front and back storage rails each having a lower end and a suspension flange extending longitudinally of and projecting laterally from said lower end, said suspension flange of said back stationary rail being formed with a first lip projecting upwardly therefrom, a plurality of notches being formed in said lip and opening upwardly therefrom to form seats at spaced intervals along the length of said back stationary rail releasably seating said lugs of said suspension rails as aforesaid, (b) a plurality of suspension rails each having a front end, a back end and an upper and a lower edge extending longitudinally between the front and back ends thereof, each suspension rail having front and back suspension notches formed in the front and back end of said upper edge to form slipways through which the flanged lower edge of the stationary rails extend, each slipway having a lug projecting inwardly at said upper edge which overlies the flange of the stationary rail which extends therethrough thereby to suspend the suspension rails from the stationary rails, the lugs of the back suspension notch being adapted to be releasably seated in the seats of the back stationary rail so as to releasably retain the back end of the suspension rails against movement along the back stationary rail while permitting movement of the front end suspension rails along the front stationary rail, said suspension rails each being adapted to support a hanger.

3. A suspension system as claimed in claim 1 wherein said suspension flange of said back stationary rail is formed with a second lip which extends in a spaced parallel relationship with respect to said first lip, said second lip being formed with a plurality of notches which open upwardly therefrom to form seats, the seats of said first lip being aligned with the seats of said second lip for releasably engaging said lugs of said suspension rails as aforesaid.

* * * * *